United States Patent [19]

Oliff

[11] 4,355,717

[45] Oct. 26, 1982

[54] WRAPAROUND ARTICLE CARRIER WITH ADJUSTABLE GIRTH

[75] Inventor: James R. Oliff, Austell, Ga.

[73] Assignee: The Mead Corporation, Dayton, Ohio

[21] Appl. No.: 337,777

[22] Filed: Jan. 7, 1982

[51] Int. Cl.[3] ..... B65D 65/00; B65D 75/00

[52] U.S. Cl. ..... 206/140; 206/427; 206/434; 206/161

[58] Field of Search ..... 206/434, 427, 158, 153, 206/147, 148, 149, 151, 152, 154, 155, 156, 157, 429, 173, 140; 229/40, 52 BC, 28 BC; 24/16 R; 217/3 FC, 3 R, 3 C

[56] References Cited

U.S. PATENT DOCUMENTS

| | | | |
|---|---|---|---|
| 3,361,331 | 1/1968 | Weiss | 229/40 |
| 3,395,791 | 8/1968 | Graser | 229/40 |
| 3,410,397 | 11/1968 | Cato . | |
| 3,478,951 | 11/1969 | Graser | 206/434 |
| 3,508,699 | 4/1970 | Graser . | |
| 4,093,116 | 6/1978 | Watkins et al. | 229/40 |

*Primary Examiner*—William Price
*Assistant Examiner*—Jimmy G. Foster
*Attorney, Agent, or Firm*—Rodgers & Rodgers

[57] ABSTRACT

For packaging groups of articles whose exterior dimensions may vary somewhat, an article carrier of the wraparound type comprises a blank of generally rectangular configuration having lap panels at its ends which may be overlapped and secured together in flat face contacting relation in alternate relative positions of long and short overlaps to form tubular structures of different girths respectively wherein at least one combination locking and retaining tab is struck from one of the lap panels and wherein at least one locking tab and at least one retaining tab are struck from the other lap panel and disposed in spaced transverse alignment with each other whereby said combination locking and retaining tab may be driven through the aperture defined by said retaining tab when said one lap panel is disposed in an outer overlapping position relative to said other lap panel and whereby said locking tab may be driven through the aperture defined by said combination locking and retaining tab when said other lap panel is disposed in an outer overlapping position relative to said one lap panel, the two different arrangements being effective to form wraparound carriers having girths of different dimensions.

7 Claims, 5 Drawing Figures

WRAPAROUND ARTICLE CARRIER WITH ADJUSTABLE GIRTH

TECHNICAL FIELD

This invention relates to article carriers of the wraparound type and is concerned with improved interlocking means whereby a particular carrier may be used for groups of articles having dimensions which vary somewhat from one group to the other.

BACKGROUND ART

U.S. Pat. No. 3,361,331 discloses a wraparound carrier having two sets of alternative locks. These locks are of the so-called toe and heel type and are formed respectively in the overlapping end portions of the blank to provide a carrier for accommodating different groups of articles whose size may vary somewhat from group to group. U.S. Pat. No. 3,361,331 is limited to the so-called heel and toe type of lock and is not adaptable for use with the so-called punch-in type of lock where a locking element is driven through a locking aperture following secure tightening of the wrapper about a group of articles.

U.S. Pat. No. 3,508,699 discloses a wraparound type carrier in which locking tabs formed in one lap panel are staggered for cooperating with aligned apertures formed in the face contacting lap panel at the other end of the blank. Alternatively, locking apertures may be staggered to cooperate with aligned locking tabs formed respectively in face contacting lap panels. Since this arrangement utilizes only a limited number of the locking tabs or the locking apertures it may not afford adequate security for the package. Furthermore this arrangement could not run on an established packaging machine using punch in type locks without substantial modification of the machine.

Also disclosed in U.S. Pat. No. 3,508,699 are locks of the type in which either a locking tab or a locking aperture is especially configured so as to afford two different locking positions. While these two locking positions might not require substantial machine modification, the security of a package formed with the so-called two position lock is of doubtful reliability.

U.S. Pat. No. 3,410,397 discloses locking and retaining tabs which cooperate in such manner as to accommodate groups of articles the size of which may vary from group to group. The retaining tabs associated with the locking aperture of U.S. Pat. No. 3,410,397 is interconnected along its side edges with the associated lap panel by perforated edge connections which do not lend themselves to the formation of a tight and secure package and for this reason are objectionable.

DISCLOSURE OF THE INVENTION

In accordance with this invention in one form, an article carrier of the wraparound type is provided in which groups of articles which may vary in size somewhat from group to group may be accommodated and wherein a combination locking and retaining tab is formed in one lap panel and which may occupy an outer position relative to the face contacting lap panel so that when the combination locking and retaining tab is driven through an aperture defined by a retaining tab in the other lap panel, a secure lock is provided and wherein a locking tab formed in the other lap panel which may occupy an outer position relative to said one lap panel is driven through the aperture defined by the combination locking and retaining tab to form a secure-wrapper which is of a different girth dimension from that formed when the combination locking and retaining tab formed in one panel is driven through an aperture defined by the retaining tab formed in the other lap panel.

BEST MODE OF CARRYING OUT THE INVENTION

Figure 1:
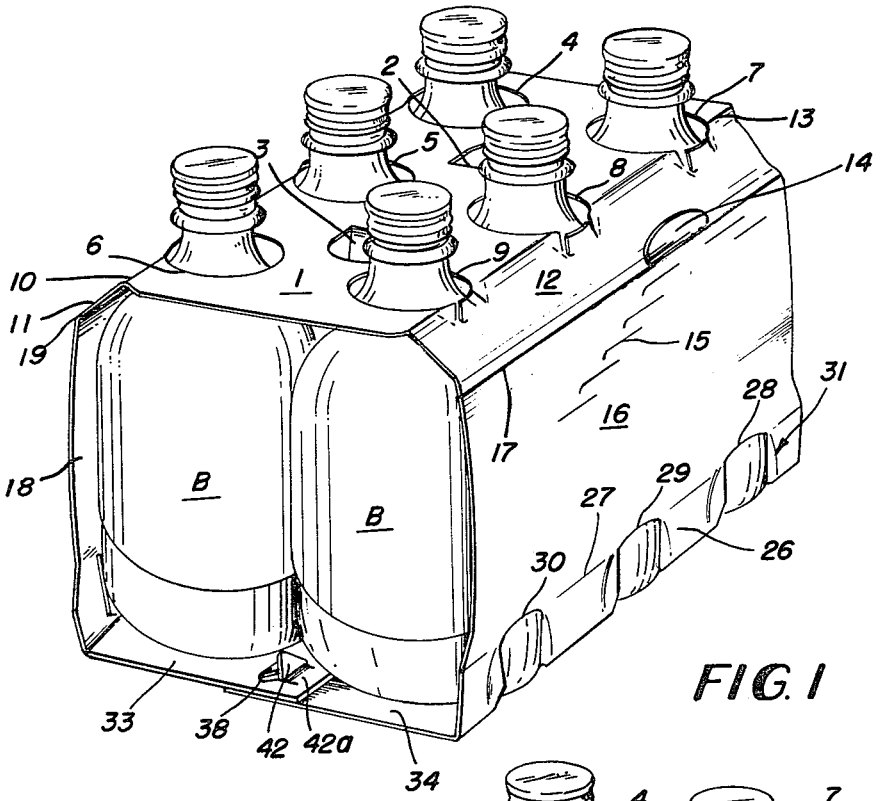
FIG. 1 is a perspective view of a set-up carton of the wrap-around type and which is formed according to this invention.

In the drawings the numeral 1 designates a top panel having finger gripping tabs 2 and 3 struck out of the top panel 1 to define finger receiving openings to facilitate portability of the carrier. Also formed in top panel 1 are a plurality of apertures 4, 5, 6, 7, 8 and 9 which are of known construction and which are for the purpose of receiving the necks of packaged articles as is apparent for example in FIG. 1. The apertures 4–9 formed in top panel 1 are provided with especially constructed cut and slit lines generally indicated at **4*a* and which are of known construction and form no part of the present invention. Foldably joined along fold line 10 to one edge of top panel 1 is a sloping panel 11 while a similar sloping panel 12 is foldably joined along fold line 13 to the opposite edge of top wall 1. A suitable pull tab 14 is formed in sloping panel 12 and a series of tear slits 15 of known construction are formed in side wall 16 which in turn is foldably joined to the bottom edge of sloping panel 12 along fold line 17**.

On the other side of the carrier a side wall 18 is foldably joined to the bottom edge 19 of sloping panel 11.

Sloping panel 20 is foldably joined to the bottom edge of side wall 18 along fold line 21 and includes a plurality of apertures 22, 23, and 24 which are of known construction and which receive the heels of adjacent bottles. Suitable structure for cushioning the bottles is of known construction and is generally indicated at 25 in connection with aperture 24.

On the opposite side of the carrier a sloping panel 26 is foldably joined along fold line 27 to the bottom edge of side wall 16 and a plurality of apertures 28, 29 and 30 are formed in sloping panel 26 and in the lower portion of side wall 16 and are of conventional construction and include yieldable structure indicated at 31 in connection with aperture 28. Apertures 28–30 receive the heels of the adjacent bottles.

Foldably joined to the lower edge 32 of sloping panel 20 is a bottom lap panel 33 while a bottom lap panel 34 is foldably joined to the lower edge 26*a* of sloping panel 26. As is well known, lap panels 33 and 34 are disposed in overlapped face contacting relation and are secured together to form a secure tubular wrapper which receives a group of packaged articles such as bottles "B".

Figure 3:
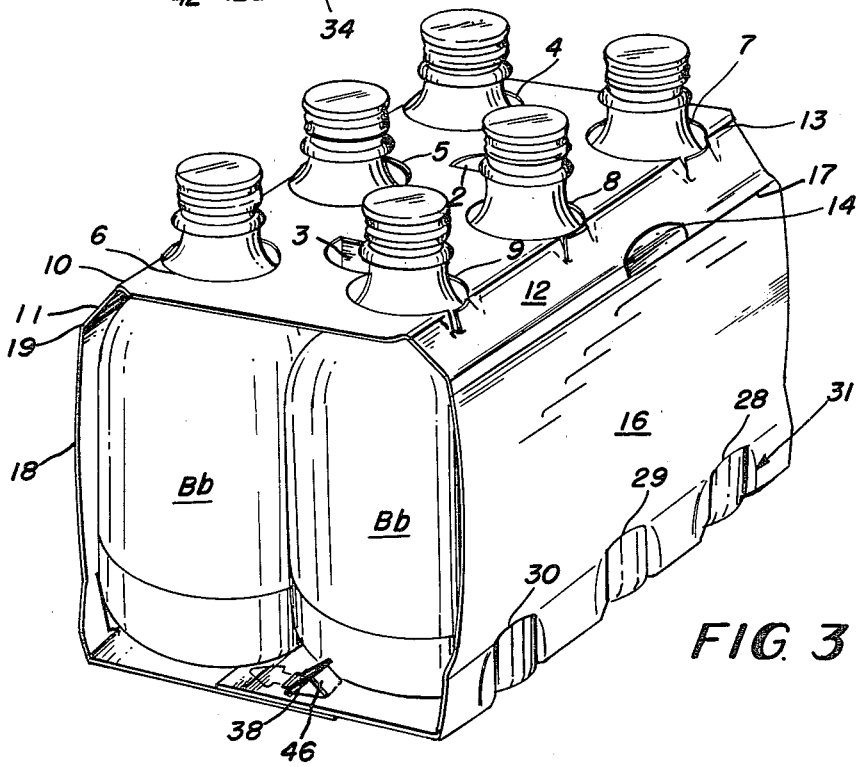
FIG. 3 is a perspective view of the carton shown in FIG. 1 but which shows the bottom lap panels with their relative positions changed from that shown in FIG. 1 to provide a carrier having a different girth from that of the carrier of FIG. 1.
Figure 2:
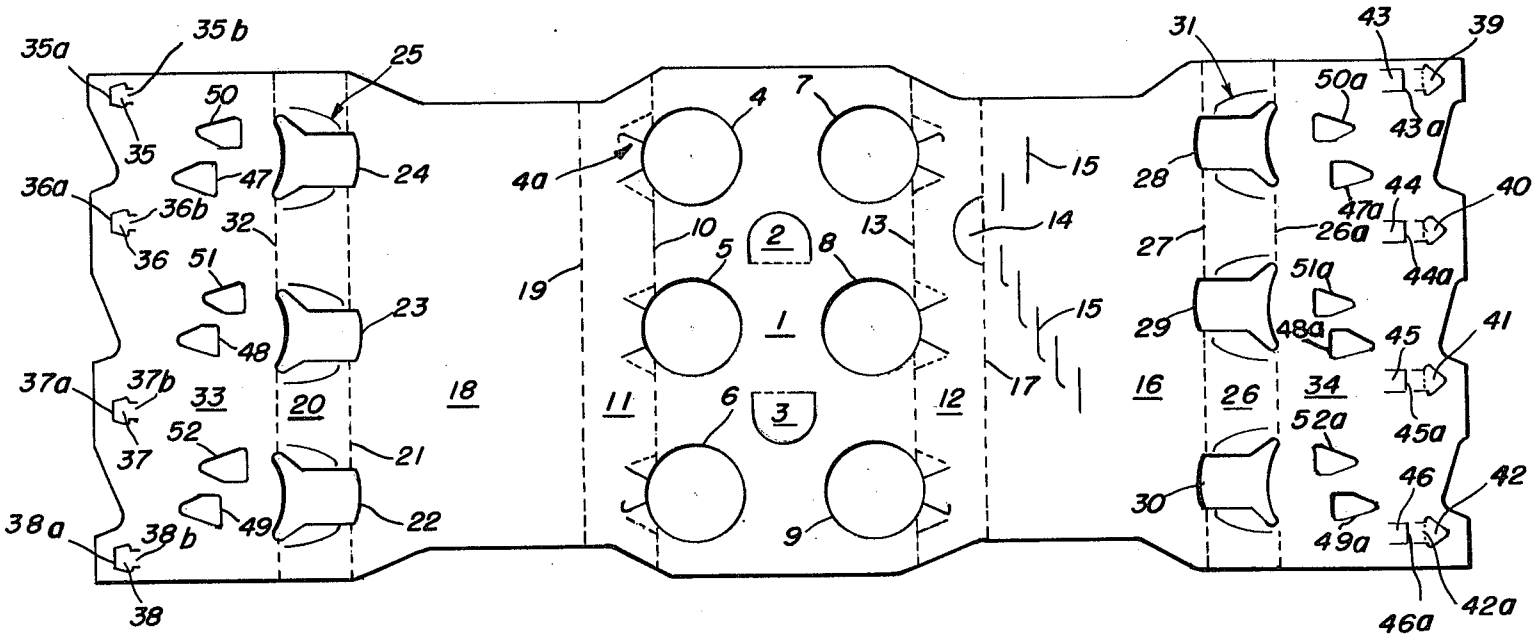
FIG. 2 is a plan view of a blank as viewed from its outside surface and which is used to form the package of FIG. 1.
Figure 4:
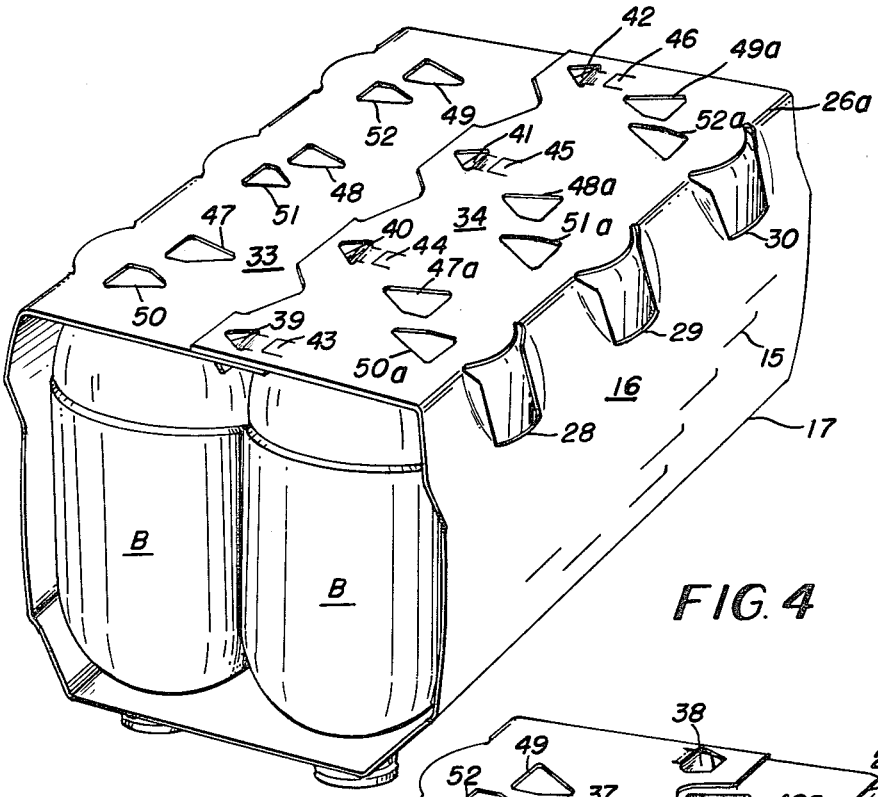
FIG. 4 is a perspective view of the carton shown in FIG. 1 but which is shown in upside down position so as to indicate the inner locking structure formed according to this invention and FIG. 5 is a perspective view of the carton of FIG. 3 shown upside down to show the orientation and cooperation of the interlocking means formed according to this invention and which affords a carton of different girth from that shown in FIGS. 1 and 4.
Figure 5:
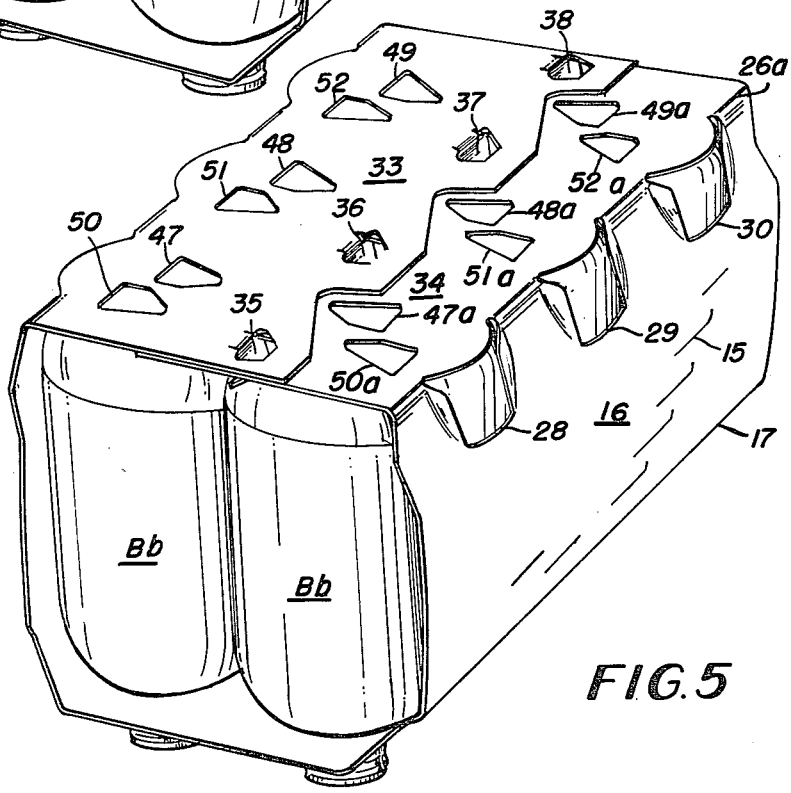

The articles shown in FIGS. 1 and 4 include a cup shaped bottom portion and are generally slightly larger than the bottles Bb shown in FIGS. 3 and 5. Thus according to this invention in one form, bottles of both sizes are packaged securely in a single wrapper formed according to this invention.

With reference to lap panel 33, it is apparent that combination locking and retaining tabs 35–38 are struck from lap panel 33. These combination locking and retaining tabs define locking edges 35*a*, 36*a*, 37*a* and 38*a* respectively. With panel 33 disposed above lap panel 34 as shown in FIG. 1, locking tabs 39–42 in lap panel 34 respectively may be driven through the apertures defined by combination locking and retaining tabs 35–38 respectively. When so arranged, combination locking tabs 35–38 function as retaining tabs and serve to prop the associated locking tabs such as 39–42 respectively in secure and locked position as shown in FIG. 1 with the base portion 42*a* of locking tab 42 disposed in secured engagement with the locking edge 38*a* of combination locking and retaining tab 38 and the girth of the wrapper extends longitudinally along the blank from base 42*a* to locking edge 38*a*. Of course the locking tabs 39–41 are similarly oriented with respect to the openings defined by combination retaining and locking tabs 35–37 respectively and their associated locking edges 35*a*–37*a* respectively. With the wrapper secured as described and as shown in FIGS. 1 and 4, bottles of a certain size are securely accommodated.

In order to accommodate bottles somewhat smaller than the bottles shown in FIGS. 1 and 4 and such as are shown in FIGS. 3 and 5, the wrapper is manipulated so that lap panel 34 is disposed above and in face contacting relationship with lap panel 33 as shown in FIGS. 3 and 5. When so arranged, combination locking and retaining tabs 35–38 are driven through the apertures defined by retaining tabs 43–46 respectively which are formed in lap panel 34. Tabs 35–38 function as locking tabs and the retaining tabs 43–46 respectively function normally as retaining tabs and the base portions 35*b*–38*b* are disposed in abutting contact with locking edges 43*a*–46*a* respectively and the space between these parts is the girth dimension of the wrapper. The result is a carrier as shown in FIGS. 3 and 5 which is of a smaller girth than the carrier shown in FIGS. 1 and 4 and which therefore securely accommodates bottles Bb which are somewhat smaller than the bottles B shown in FIGS. 1 and 4.

In order properly to tighten the wrapper about the groups of articles, tightening apertures are provided in lap panels 33 and 34 and are designated 47–49 in lap panel 33 and are designated 47*a*–49*a* in lap panel 34. Suitable machine tightening elements enter these tightening apertures and tighten the package for the larger group of articles as shown for example in FIGS. 1 and 4 prior to locking these lap panels together.

In like fashion tightening apertures 50–52 are formed in lap panel 33 and cooperate with tightening apertures 50*a*–52*a* formed in lap panel 34 so as to form the package such as that shown in FIGS. 3 and 5.

The arrangement of tightening apertures formed in lap panels 33 and 34 and their cooperation with machine tightening elements are disclosed and claimed in U.S. patent application Ser. No. 342,400 filed 1-25-82.

INDUSTRIAL APPLICABILITY

This invention is particularly well suited for use in conjunction with packaging of groups of articles which are similar to but slightly different in size and to which the invention is also applicable without requiring adjustment of machine elements or of machine timing of such elements and thus provides a substantial degree of adaptability whereby packaging efficiency is substantially enhanced in connection with the use of article carriers of the wraparound type.

I claim:

1. In an article carrier of the wraparound type formed from a blank of generally rectangular configuration and having lap panels at its ends which are overlapped and secured together in flat face contacting relation in alternate relative positions of long and short overlaps to form tubular structures of different girths respectively, an improved interlocking means comprising a combination locking and retaining tab struck from one of said lap panels, a locking tab struck from the other of said lap panels, and a retaining tab struck from the other of said lap panels and disposed in spaced transverse alignment with said locking tab, whereby said combination locking and retaining tab is driven through the aperture defined by said retaining tab when said one lap panel is disposed in an outer overlapping position relative to said other lap panel and said locking tab is driven through the aperture defined by said combination locking and retaining tab when said other lap panel is disposed in an outer overlapping position relative to said one lap panel.

2. Interlocking means according to claim 1 wherein said locking tab is disposed between said retaining tab and the adjacent end edge of said blank.

3. Interlocking means according to claim 1 wherein a plurality of combination locking and retaining tabs are struck from said one lap panel and wherein a plurality of locking tabs and of retaining tabs are struck from said other panel.

4. Interlocking means according to claim 3 wherein said combination locking and retaining tabs are transversely aligned with each other and said locking tabs are transversely aligned with each other while said retaining tabs are transversely aligned with each other.

5. Interlocking means according to claim 1 wherein the aperture defined by said retaining tab includes a locking edge generally parallel with the adjacent end edge of the blank and the length of the girth of the carrier when said one lap panel occupies an outer position and with said combination locking and retaining tab driven through said aperture defined by said retaining tab is approximately equal to the longitudinal distance along the blank between the base of said combination locking and retaining tab and said locking edge of said aperture defined by said retaining tab.

6. Interlocking means according to claim 1 wherein the aperture defined by said combination locking and retaining tab includes a locking edge generally parallel with the adjacent end edge of the blank and length of the girth of the carrier when said other lap panel occupies an outer position and with said locking tab driven through the aperture defined by said combination locking and retaining tab is approximately equal to the longitudinal distance along the blank between the base of said locking tab and said locking edge of said aperture defined by said combination locking and retaining tab.

7. In combination with the interlocking means of claim 1 an improved tightening means comprising at least one pair of tightening apertures formed respectively in said lap panels for receiving machine tightening elements operable to impart tightening action to said blank when disposed about a group of articles, said one pair of tightening apertures being spaced a predetermined distance from one longitudinal edge of said blank, and a second pair of tightening apertures formed respectively in said lap panels for receiving machine tightening elements operable to impart tightening action to said blank when disposed about a group of articles, said second pair of tightening apertures being spaced said predetermined distance from the longitudinal edge of said blank which is opposite from said one longitudinal edge.

* * * * *